US009701447B2

(12) United States Patent
Stodd

(10) Patent No.: US 9,701,447 B2
(45) Date of Patent: Jul. 11, 2017

(54) RECLOSABLE LID FOR A VACUUM FOOD CONTAINER AND HAVING A VACUUM RELEASE BUTTON

(71) Applicant: Container Closure Technologies LLC, Dayton, OH (US)

(72) Inventor: R. Peter Stodd, Vandalia, OH (US)

(73) Assignee: Container Closure Technologies LLC, Dayton, OH (US)

( * ) Notice: Subject to any disclaimer, the term of this patent is extended or adjusted under 35 U.S.C. 154(b) by 0 days.

(21) Appl. No.: 15/186,997

(22) Filed: Jun. 20, 2016

(65) Prior Publication Data

US 2016/0376071 A1 Dec. 29, 2016

Related U.S. Application Data

(63) Continuation-in-part of application No. 14/751,484, filed on Jun. 26, 2015.

(51) Int. Cl.

| | |
|---|---|
| ***B65D 43/02*** | (2006.01) |
| ***B21D 51/00*** | (2006.01) |
| ***B65D 51/16*** | (2006.01) |
| ***B65D 53/02*** | (2006.01) |

(52) U.S. Cl.

CPC ..... *B65D 43/0202* (2013.01); *B21D 51/00* (2013.01); *B65D 51/1677* (2013.01); *B65D 53/02* (2013.01); *B65D 2543/00277* (2013.01); *B65D 2543/00425* (2013.01)

(58) Field of Classification Search

CPC ..... B65D 2543/00425; B65D 2543/00277; B65D 43/02; B65D 43/0202; B65D 81/2038; B65D 51/1672; B65D 81/2007

USPC ..... 220/359.1, 231, 295, 303, 266; 215/262, 215/253

See application file for complete search history.

(56) References Cited

U.S. PATENT DOCUMENTS

| | | | |
|---|---|---|---|
| 3,152,711 | A | 10/1964 | Mumford et al. |
| 3,355,058 | A | 11/1967 | Asbury |
| 3,410,436 | A | 11/1968 | Foss et al. |
| 5,680,952 | A | 10/1997 | Chasteen |
| 5,979,688 | A | 11/1999 | Stodd |
| 6,206,220 | B1 | 3/2001 | Stodd |
| 2014/0103044 | A1 | 4/2014 | Ramsey et al. |

*Primary Examiner* — Andrew Perreault

(74) *Attorney, Agent, or Firm* — Jacox, Meckstroth & Jenkins

(57) ABSTRACT

A sheet metal lid has a rim portion with a resilient sealant for releasably coupling and sealing the lid to a glass or other container enclosing a vacuum food product. The lid is successively pressed with progressive dies to form an upwardly projecting and thinner dome-shape portion which is progressively formed into annular cavity surrounding a vacuum release vent button. The button has a sloping top wall with an upper edge portion connected to a substantially vertical arcuate wall portion adjacent an arcuate score line located in opposing relation to an arcuate reinforcing bead within the cavity. A sealant material is bonded to the inner surface of the button and overlies the score line. The vent button is preferably located below the rim both before and after the vacuum is released, and the sealant material reseats to cover the score line and protect the food product.

5 Claims, 7 Drawing Sheets

(PRIOR ART)

RECLOSABLE LID FOR A VACUUM FOOD CONTAINER AND HAVING A VACUUM RELEASE BUTTON

RELATED APPLICATION

This application is a continuation-in-part of application Ser. No. 14/751,484, filed Jun. 26, 2015.

BACKGROUND OF THE INVENTION

This invention relates to a closure or lid for a vacuum food container and of the type disclosed in applicant's U.S. Pat. Nos. 5,979,688 and 6,206,220, the entire disclosure of which is incorporated by reference. These patents are directed to a thin sheet metal closure or cap or lid for a vacuum packed and sealed food container wherein the closure is removably sealed to the container and reclosable on the container. Commonly, the container is formed of glass but may also be formed plastic or sheet metal, and the vacuum within the sealed container is released to facilitate or simplify the removal of the closure or lid from the container with reduced torque. Other forms of containers with reusable closures for vacuum food containers and having a vacuum release structure before the closure is removed from the container are disclosed in U.S. Pat. No. 3,410,436 and U.S. Patent Publication No. US 2014/0103044.

As used herein, the term container includes a glass or sheet metal or plastic container, and the term lid includes any form of closure such as a twist-on, twist-off sheet metal cap or a press-on, press-off sheet metal cap or lid for a container. The lid has a peripheral chime or rim portion with a bonded sealant material to form a releasable sealed coupling between the lid and the container. In such an enclosed vacuum food container and lid assembly, it has been found desirable to add an easily activated vacuum release button to the lid after the lid has been completely formed on tooling which shapes the lid and has the bonded sealant material on the inner surface of the rim portion of the lid. It would be desirable to minimize the thickness of the sheet metal, such as sheet steel or aluminum, which forms the lid and to provide a clearly visible tamper-proof indication when the vacuum has been released from the container.

SUMMARY OF THE INVENTION

The present invention is directed to an improved sheet metal lid for a container having a vacuum enclosed food product and which has a vacuum release button to facilitate removal of the lid, and to the tooling and method for producing the lid. The tooling and method are especially adapted for adding the vacuum release button to a lid which has been pre-formed to be releasably attached and sealed to a glass jar or sheet metal container. In accordance with a preferred embodiment of the invention, a sheet metal lid having a peripheral rim portion with a bonded sealant material has a center portion formed with tooling to form an upwardly projecting and rounded dome-shaped thinner portion in a first stage of a progressive die. The dome-shaped portion is flattened in successive stages to form an upwardly projecting vent button within an annular cavity. The button has a sloping or tapered top wall which has an upper edge portion connected to a substantially vertical arcuate wall portion. An arcuate score line is formed within the lid adjacent the bottom of the arcuate wall portion, and the score line may be progressively deeper from the center of the arcuate score line to the opposite ends of the score line.

A curved or arcuate reinforcing bead is formed within the cavity at the lower end of the sloping top wall and in opposing relation to the arcuate vertical wall portion. A sealant material is bonded to the inner surface of the button below the score line. When the upper edge portion of the vacuum release button is depressed or pressed downwardly, the sealant separates or peels away from the inner surface of the lid to release the vacuum within the container. When the button is released, the sealant recontacts due to spring hinge action of the reinforced opposite side of the button. The configuration of the button prevents the finger depressing the button from engaging the sheared sheet metal edge of the lid at the score line and thereby protects the depressing finger that releases the vacuum within the container.

Other features and advantages of the invention will be apparent from the following description, the accompanying drawings and the appended claims.

DESCRIPTION OF PREFERRED EMBODIMENTS

Figure 1:
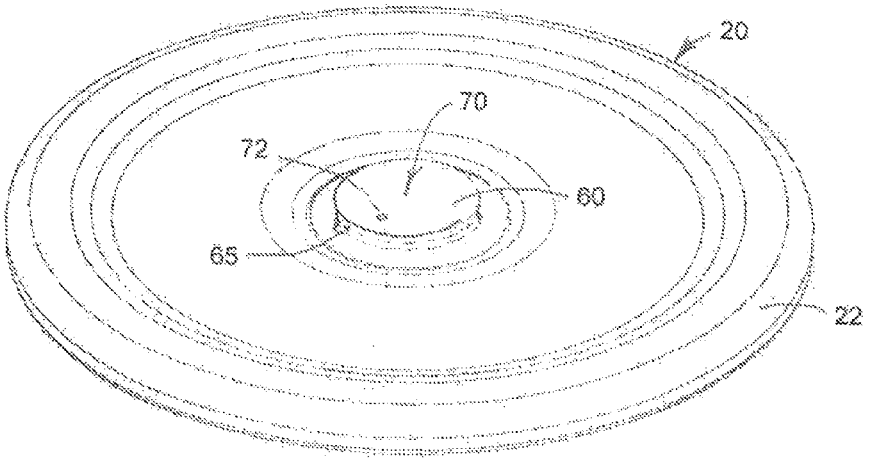
FIG. 1 is a perspective view of a sheet metal lid constructed in accordance with one embodiment of the invention.
Figure 4:
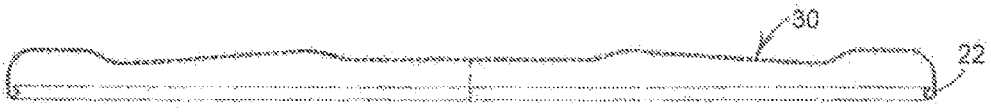
FIG. 4 is a vertical section of a conventional sheet metal lid before sealant material is bonded to the rim portion of the lid.
Figure 5:
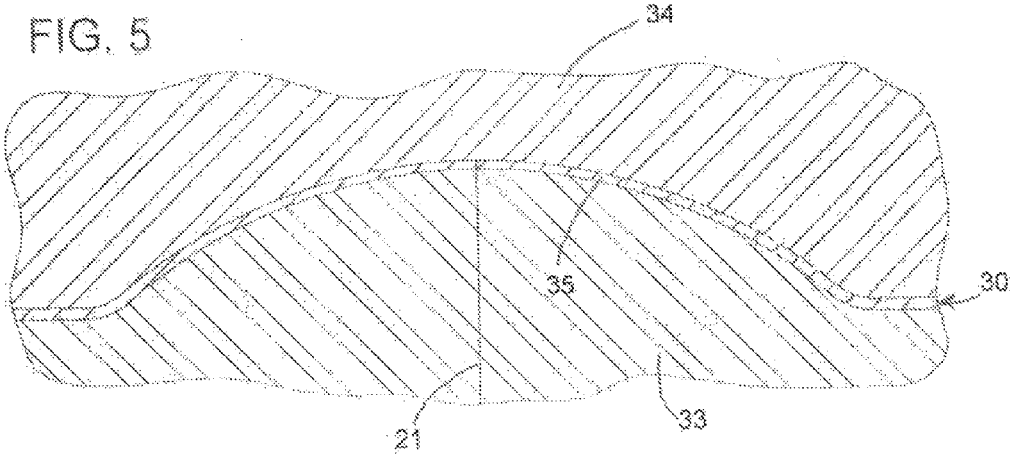
FIGS. 5-8 are enlarged vertical sections through the progressive die tooling for forming a vacuum release button to produce the lid shown in FIGS. 1-3.
Figure 6:
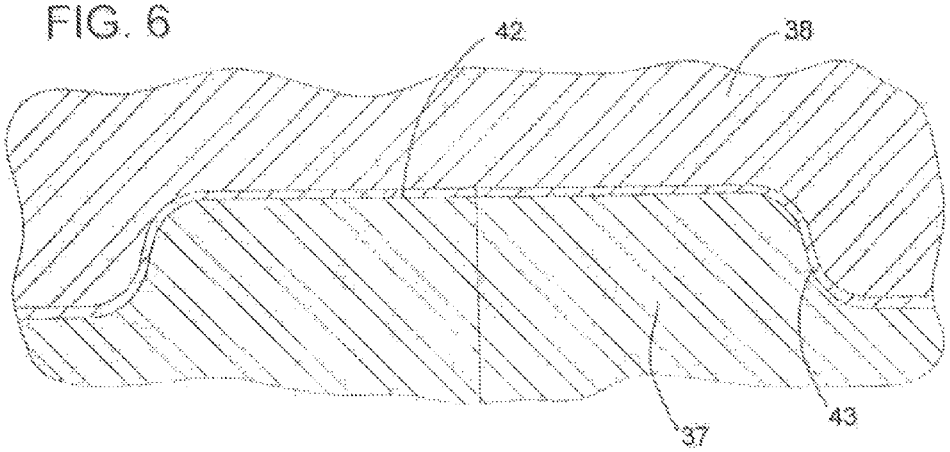
Figure 7:
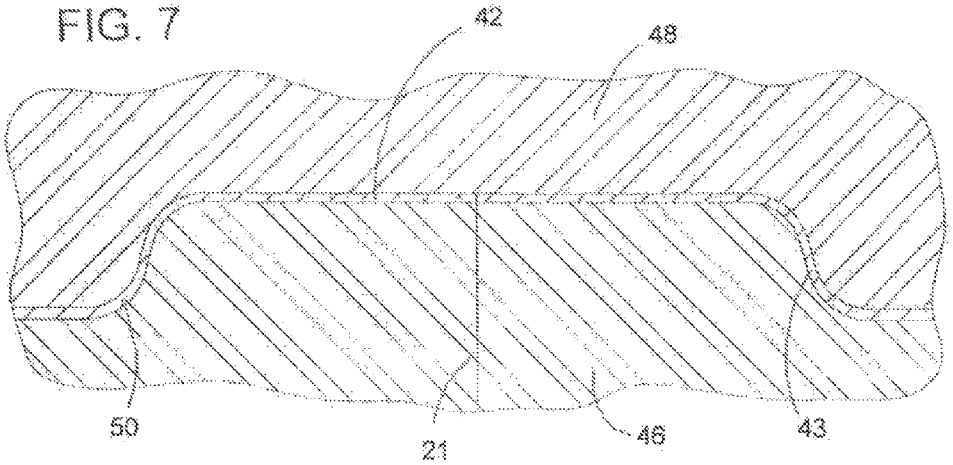

FIG. 1 illustrates a sheet metal lid 20 having a vertical centerline 21 (FIG. 2) formed in accordance with the invention to include a peripheral chime or horizontal rim portion 22 which releasably engages or attaches to an upper portion 24 (FIG. 2) of a food container 25 in a conventional manner with a twist-on, twist-off coupling or a press-on and press-off coupling to the container. The inner surface of the rim portion 22 of the lid 20 includes a bonded resilient sealant material 28, such as a food grade PVC or plastisol, which forms a vacuum-tight seal with the container 25, in a conventional manner. A conventional sheet metal lid 30 is shown in cross-section in FIG. 4 and is commonly produced of thin sheet metal or sheet steel having a thickness, for example, of about 0.007 inch. After the sealant material 28 is bonded to the rim portion of the lid 30, the lid is preferably transferred to a high speed mechanical press having progressive tooling or dies which form the lid 30 into the lid 20 in accordance with the invention.

Referring to the progressive tooling or die stages shown in FIGS. 5-8 to produce a lid in accordance with the invention when starting from a conventional lid, a center portion of a conventional sheet steel lid 30 is formed upwardly in a first stage of the progressive tooling by die components 33 and 34 to form a dome-shaped center portion 35 having a reduced wall thickness at the top, for example, of about 0.006 inch. In the next progressive die stage of FIG. 6, die components 37 and 38 form the dome-shaped portion 35 into a flat wall top portion 42 and a circular side wall portion 43. In a following progressive die stage of FIG. 7, die component 46 and 48 form a crescent-shape or arcuate score line 50 within an inner surface or product side of the sheet metal adjacent the base or bottom portion of the flat top button portion 42.

Figure 14:
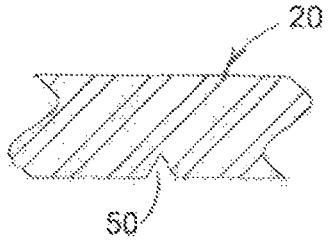
Figure 15:
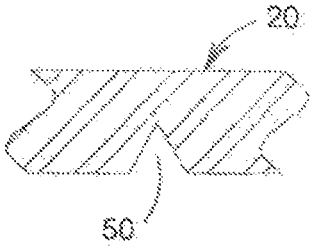
Figure 16:
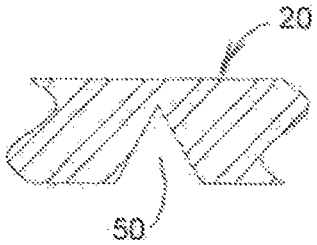
Figure 17:
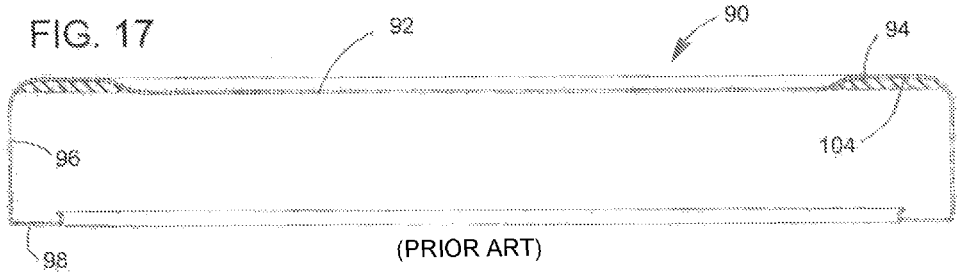
FIG. 17 is a vertical section of a conventional twist on, twist off lid for a glass vacuum food container.

Referring to FIGS. 12-16, the arcuate score line 50 is preferably formed so that it has a maximum depth within the inner surface of the sheet metal at the center of the arcuate score line, as shown in FIG. 16. The depth of the score line becomes progressively less towards opposite ends of the score line, as shown in FIGS. 14 & 15 until the score line terminates at FIG. 13 to provide the score line with an arcuate distance of about 240 degrees. For example, in sheet steel having a thickness of about 0.007 inch, the sheet steel 30 has a minimum thickness at 55 at the bottom of the score line 50 of about 0.0008 inch and located at the center of the arcuate score line shown in FIG. 16. The score line 50 may also be formed in the top or outer surface of the lid 20.

Figure 8:
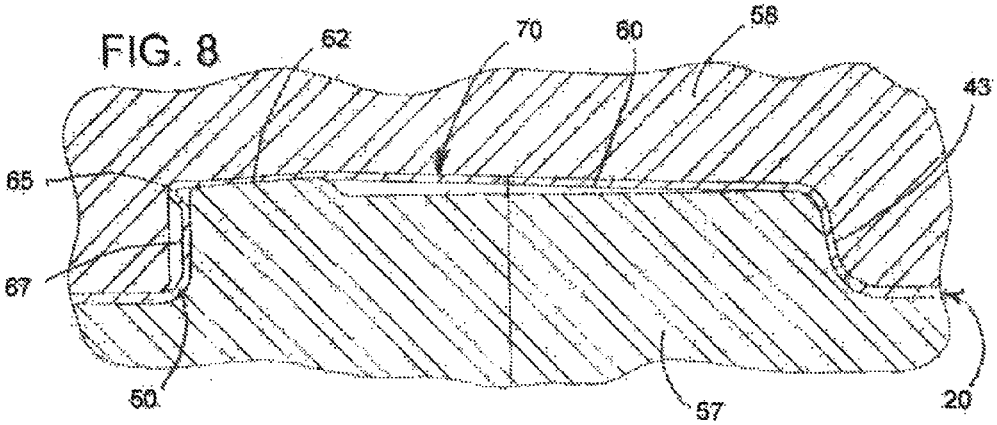
Figure 9:
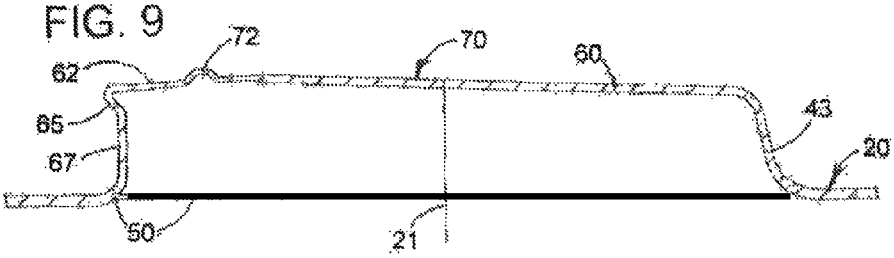
FIG. 9 is an enlarged vertical section through the vacuum release button formed within the lid and showing the arcuate score line before sealant material is bonded to the inner surface of the button.

Referring to FIG. 8, die components 57 & 58 at progressive die stage form the flat top button 42 into a slightly inclined or sloping top wall portion 60 and a thinner edge portion 62 of about 0.004 inch and a laterally outwardly projecting arcuate lip portion 65. The lip portion 65 overlies the arcuate score line 50 by about 90 degrees, and dies 57 & 58 also form a part cylindrical or arcuate vertical wall portion 67 all of which cooperate to form vacuum release button 70. As shown in FIG. 9, the tooling components 57 & 58 may include an upward projection and a recess, respectively, to form an upwardly projecting dimple 72 within the top edge portion 62 of the button 70. As mentioned above and shown in FIG. 12, the arcuate lip portion 65 preferably extends peripherally by an arcuate distance less that the arcuate length of the score line 50, for example, with the lip portion 65 extending about 90 degrees and the score line 50 extends about 240 degrees.

Figure 2:
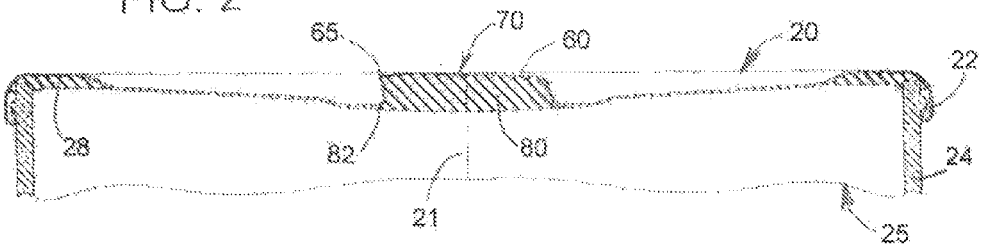
FIG. 2 is a vertical section of the lid shown in FIG. 1 and releasably attached and sealed to the top portion of a glass vacuum food container.
Figure 3:
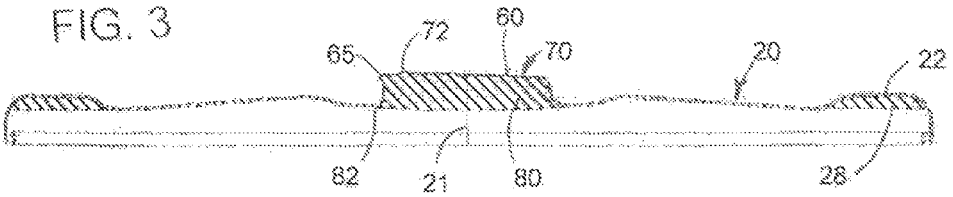
FIG. 3 is a vertical section of the lid shown in FIG. 1 before being attached or coupled to a container.
Figure 10:
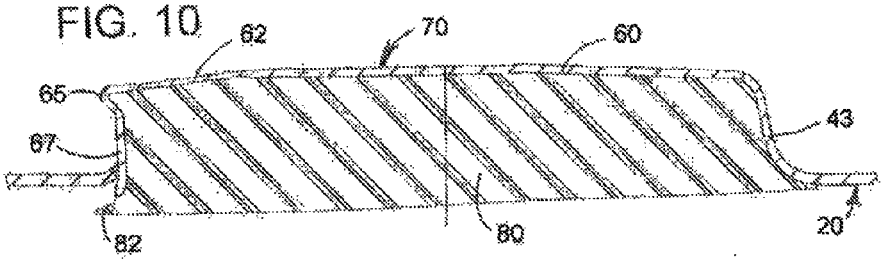
FIG. 10 is an enlarged vertical section through the vacuum release button after sealant material is bonded to the inner surface of the button and after the button is depressed to shear the score line and release vacuum within the container.

Referring to FIGS. 2,3, & 10, the vacuum release button 70 is provided with a resilient sealant material 80, such as the material 28, and which is bonded to the inner surface of the button 70. The material 80 includes an outwardly projecting peripheral flange portion 82 which covers and seals the score line 50 and protects the score line from being exposed to the food product within the container 25 and thereby protects the food product from being exposed to the sheet metal or sheet steel which forms the score line.

Figure 11:
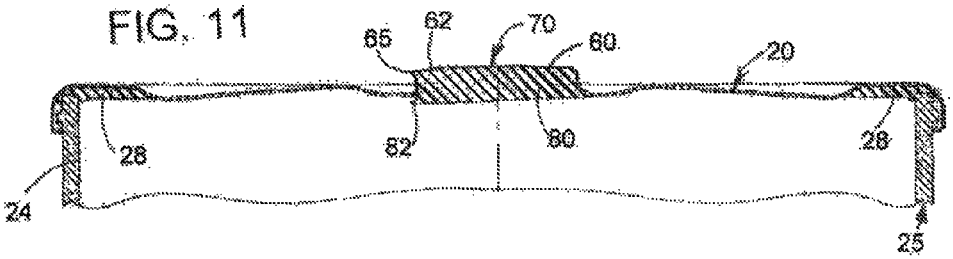
FIG. 11 is a vertical section similar to FIG. 2 and showing the vacuum release button projecting above the rim portion of the lid after vacuum has been released from the container.
Figure 12:
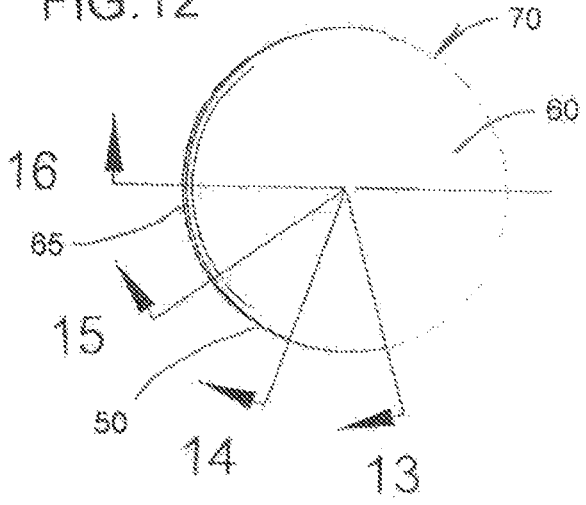
FIG. 12 is an enlarged top view of the vacuum release button and showing with enlarged fragmentary sections of FIGS. 13-16 the progressive depth of the crescent or arcuate-shape score line formed within the inner surface of the lid, as shown in FIG. 9.
Figure 13:
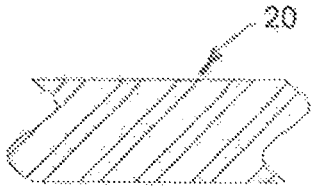

After the sheet metal lid 70 is attached or coupled to a container 25 and a vacuum has developed above the food product within the container, the top surface of the vacuum release button 70 is substantially flush with the top surface of the chime or rim portion 22 of the lid, as shown in FIG. 2. When it is desired to release the vacuum to facilitate the removal of the lid from the container 25, the thinner edge portion 62 of the button is depressed slightly downwardly by a finger to shear or sever the sheet metal lid at the score line 50 and thereby release the vacuum, as shown in FIGS. 10 & 11. When the button 70 and vacuum are released, the button 70 pops upwardly by the spring hinge action in the wall portion 43 opposite the score line 50, and the lid 20 returns to a normal position as shown in FIG. 3. In this position, the top surface of the button 70 may be above the top surface of the rim portion 22 to provide a clear indication that the vacuum has been released from the container. When the button 70 returns to its original position, as shown in FIG. 3, the flange portion 82 of the sealant material 80 recontacts or engages the inner surface of the lid, as shown in FIG. 3 and thereby enables the food product within the container to remain fresh and prevents the food product from being exposed to the edge surface of the sheet metal forming the score line 50.

Figure 22:
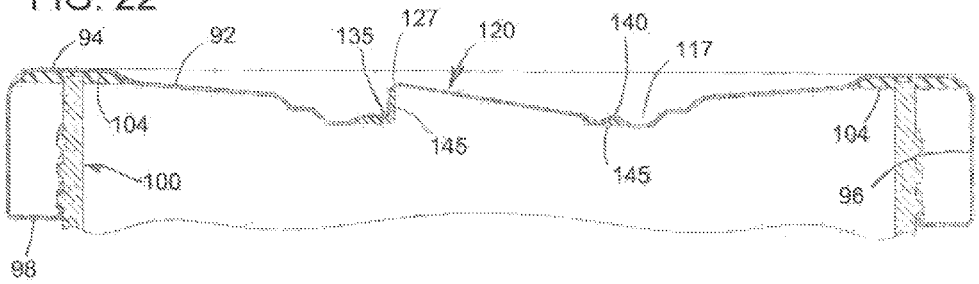
FIG. 22 is a vertical section of the lid produced with the steps shown in FIGS. 18-21 and attached to the open end of a glass container having received a food product under a vacuum.

In accordance with another embodiment of the invention, a conventional sheet metal lid 90 has a vertical center axis and a flat circular top wall 92 with an upwardly projecting and horizontal annular rim portion 94, a cylindrical side wall portion 96 and an inwardly projecting annular portion 98 adapted to be threaded onto the upper end portion of a container, such as the glass container 100 shown in FIG. 22. However, the conventional lid 90 may have other means for releasably connecting or securing the sheet metal lid 90 to the open end portion of a container such a press-on lid or a lid having peripherally spaced thread elements which engage external threads on an open top container used for a food product. A resilient sealant material 104, such as the material 28 mentioned above, is applied to the inner surface of the rim portion 94 to form a fluid tight seal with the top end surface of the container 100, as shown in FIG. 22.

Figure 18:
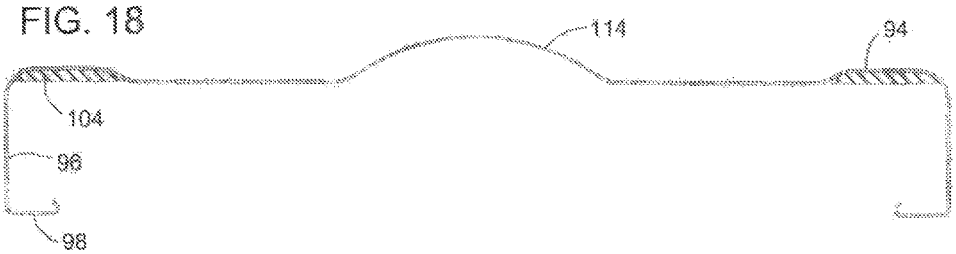
(PRIOR ART) FIG. 18
FIGS. 18-21 are vertical sections of the lid and showing progressive die or forming steps for adding a vacuum release button to the lid of FIG. 17 in accordance with another embodiment of the invention.
Figure 19:
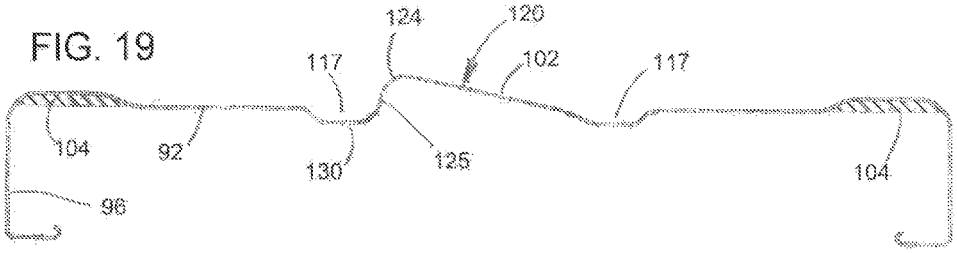

Further, in accordance with the invention, the conventional lid 90 is converted into a lid 110 (FIG. 21) according to an embodiment of the current invention on a mechanical press equipped with progressive dies or tooling. The tooling initially presses upwardly on a center portion of the top wall 92 to form a dome-shape center portion 114 (FIG. 18) which has a wall thickness thinner than the thickness of the wall 92 surrounding the dome portion 114. The portion 114 is then pressed downwardly at a following tooling stage to form an annular cavity 117 surrounding an upwardly projecting vent button 120. The button has an inclined or sloping non-horizontal top wall 122 extending from the cavity 117 upwardly to an arcuate curved wall portion 124 which connects the top wall 122 to a slightly inclined arcuate wall portion 125, as shown in FIG. 19. Subsequent stages of the progressive die tooling form the vent button 120 so that the top wall 122 has an upper edge portion 127 (FIG. 20) with a smaller radius and a substantially vertical arcuate wall 128. An annular wall portion 130 forming the cavity 117 is then formed at another progressive die stage with an arcuate score line 135 located within the top surface of the wall portion at the bottom of the arcuate vertical wall 128.

Figure 20:
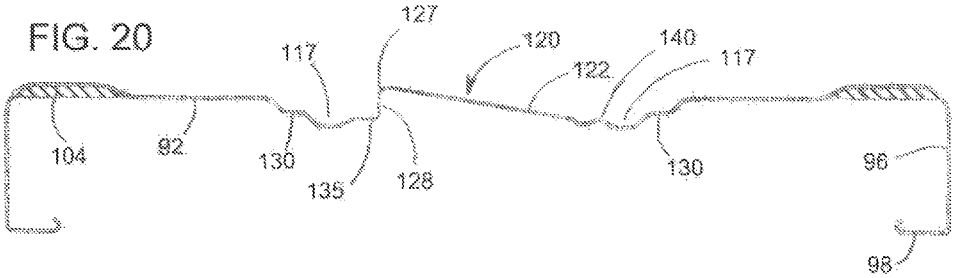
Figure 24:
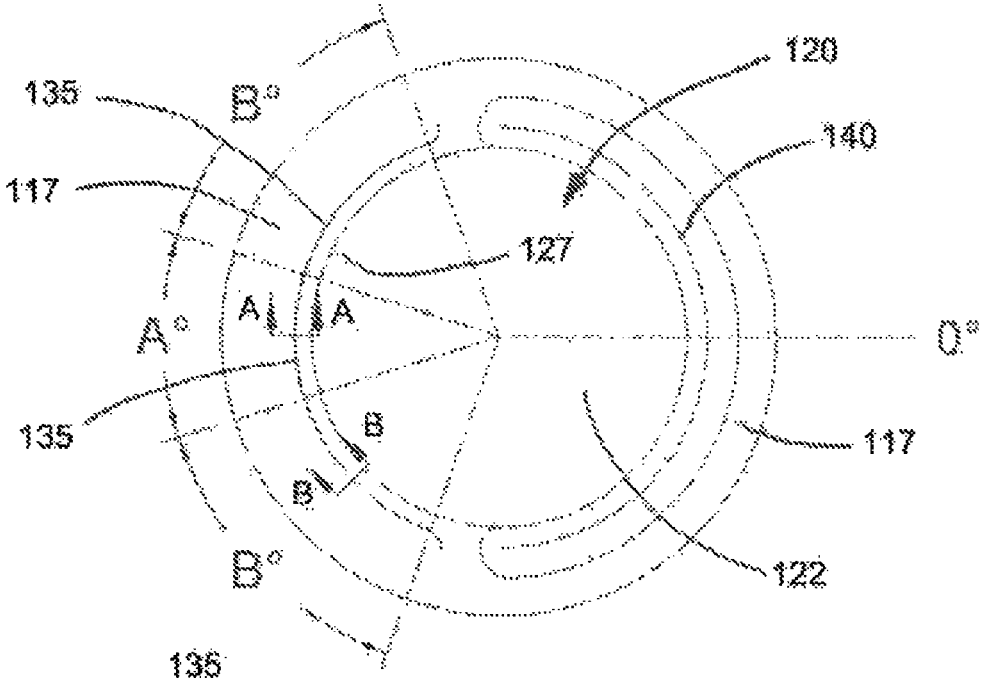
FIG. 24 is enlarged top view of the vacuum release button shown in FIG. 21 and showing the arcuate score line and opposing arcuate reinforcing rib or bead adjacent the button.
Figure 25:
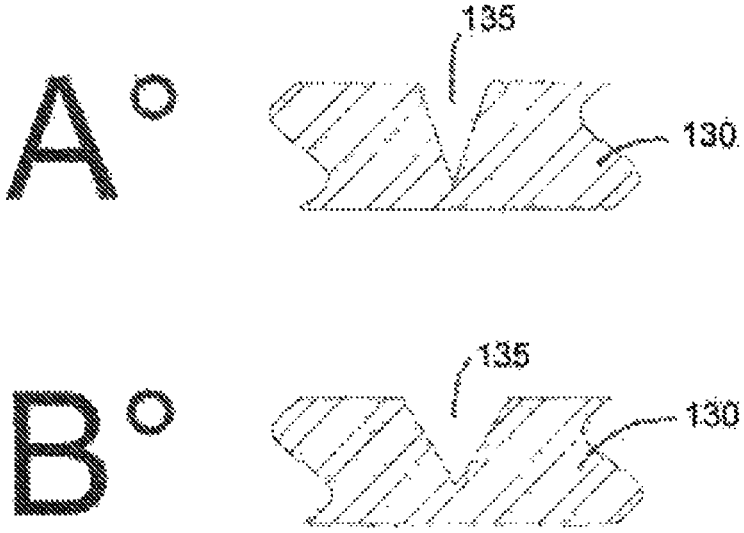
FIG. 25 is enlarged section views of the arcuate score line with a progressively changing depth.

Referring to FIG. 24, the arcuate score line 135 may have its greatest depth at the center portion of the score line in the arcuate zone A° (FIG. 25) and a progressively shallower score line depth towards the opposite ends of the score line, as shown in FIG. 24 in each of the arcuate zones B°. However, the arcuate score line 135 may also have a uniform depth, for example, as shown by the depth in the arcuate portion A° in FIGS. 24 and 25. Referring to FIGS. 20 and 24, a following progressive die stage forms a curved or arcuate reinforcing rib or bead 140 which projects upwardly and extends in opposing relation to the vertical arcuate wall 128. The arcuate bead 140 preferably extends about 180°, as shown in FIG. 24. The sloping top wall 122 of the vent button 120 may also be reinforced by deforming the top wall or by adding one or more sloping ribs.

Figure 21:
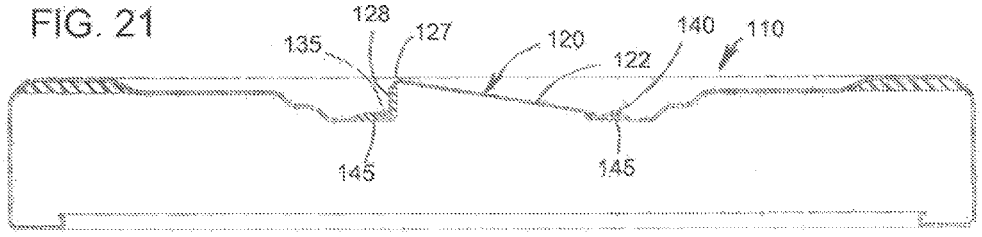

The vent button 110 preferably includes a resilient sealant material 145 (FIG. 21) which may be annular or a ring of material which also covers the inner surface of the arcuate wall 128 and projects radially outwardly to cover the bottom or inner surface of wall portion 130 under the score line 135. The sealant material 145 may also surround the vent button 120 and fill the upwardly projecting reinforcing bead 140, as shown in FIGS. 21 and 22.

Figure 23:
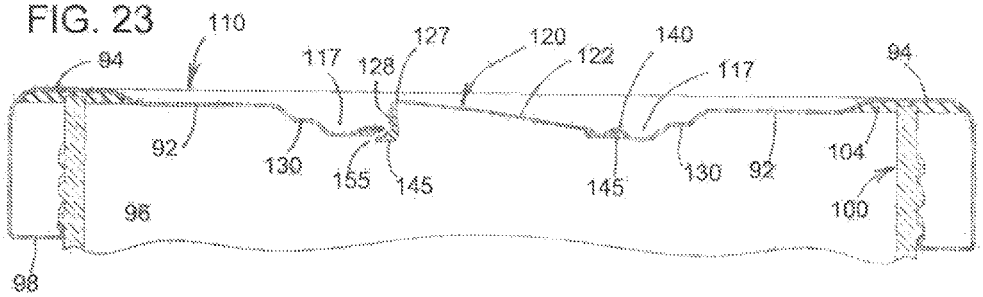
FIG. 23 is a vertical section similar to FIG. 22 and after the vacuum has been released.

The sheet metal reusable lid 110 having a vacuum release button 120 constructed in accordance with the invention, is ideally suited for closing a glass container 100 or other rigid container that receives a vacuum enclosed food product. The partial vacuum retracts the lid and vacuum release button 120 to a slightly concave position as shown in FIG. 22 when the top edge portion 127 of the button is slightly below the top surface of the rim portion 94. When it is desired to release the vacuum within the container 100, the upper edge portion 127 of the top wall 122 is depressed on pushed downwardly by a thumb or finger or tool to break or rupture the score line 135. This also causes the sealant material 145 to shear or break away or peel from the lid portion under the score line to define a very small or narrow gap 155, as shown in FIG. 23. When the pressure on the push button 120 is released, the push button returns to its normal position, as shown in FIG. 21. By releasing the vacuum and allowing air to enter the container above the food product, the push button 120 significantly reduces the torque required to remove or twist off the lid 110 from the container 100 or reduces the force required to snap the lid from a container. In addition, the spring back of the push button 120 is sufficient to close the gap 155, and the spring back is assisted by the arcuate reinforcing rib or bead 140.

As apparent from the above drawings and description, the progressive tooling steps for forming a vacuum release push button are ideally suited for use in an offline press after conventional lids have been produced and for converting existing removable lids. This eliminates the need for designing and making new tooling for producing a new lid with a vacuum release button and the substantial additional cost for the new tooling.

While the lid 20 or 110 and the progressive tooling method steps for forming the lids herein described constitute preferred embodiments of the invention, it is to be understood that the invention is not limited to the precise lids and method steps described, and that changes may be made therein without departing from the scope of the invention as defined in the appended claims.

What is claimed is:

1. A method of converting a conventional lid by adding a vacuum release button to a thin sheet metal lid having a vertical axis and a horizontal peripheral rim portion with a sealant material bonded to the lid and adapted to be releasably secured to the open end portion of a container having a vacuum enclosed food product, the method comprising the steps of pressing a center portion of the lid upwardly to form a rounded dome-shape portion having a sheet metal thickness less than the sheet metal thickness of a lid portion extending around the dome-shape portion, pressing the dome-shape portion downwardly to form an annular cavity surrounding an upwardly projecting vent button, forming the vent button with a non-horizontal sloping top wall extending upwardly to a top edge portion of the top wall with the top edge portion connected to a substantially vertical arcuate wall, forming a curved reinforcing bead within the lid portion forming the cavity at a lower end of the sloping top wall and in opposing relation to the substantially vertical arcuate wall, pressing an arcuate score line into the sheet metal lid portion forming the cavity and adjacent a bottom portion of the substantially vertical arcuate wall, bonding a sealant material to an inner surface of the button below the score line with the sealant material being effective to define a vacuum release gap in response to depressing the top edge portion of the button above the score line to shear the score line for releasing vacuum from the container.

2. A method as defined in claim 1 wherein the step of bonding the sealant material to the inner surface of the button is performed after the sealant material is bonded to the rim portion of the lid.

3. A method as defined in claim 1 and including the step of forming the arcuate score line with a depth progressively reducing from a center portion of the score line under the top edge portion to opposite ends of the score line.

4. A method as defined in claim 1 wherein the step of bonding a sealant material to the inner surface of the button comprises bonding a ring of the sealant material to the inner surface of the button within the annular cavity.

5. A method as defined in claim 1 wherein the annular cavity and the vent button are formed to remain below the top surface of the rim portion both before and after the top edge portion of the vent button is depressed to shear the score line.

* * * * *